US010287125B2

(12) United States Patent
Zhang et al.

(10) Patent No.: US 10,287,125 B2
(45) Date of Patent: May 14, 2019

(54) BANKNOTE ROLLING-OUT CONTROL METHOD AND APPARATUS, AND BANKNOTE STORAGE DEVICE

(71) Applicant: GRG Banking Equipment Co., Ltd., Guangzhou, Guangdong (CN)

(72) Inventors: Tao Zhang, Guangdong (CN); Zhiqiang Sun, Guangdong (CN); Hanfeng Xiao, Guangdong (CN); Wenqing Wu, Guangdong (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 15/551,018

(22) PCT Filed: Aug. 12, 2015

(86) PCT No.: PCT/CN2015/086730
§ 371 (c)(1),
(2) Date: Aug. 14, 2017

(87) PCT Pub. No.: WO2016/141672
PCT Pub. Date: Sep. 15, 2016

(65) Prior Publication Data
US 2018/0029818 A1 Feb. 1, 2018

(30) Foreign Application Priority Data
Mar. 6, 2015 (CN) ..... 2015 1 0100824

(51) Int. Cl.
*G07D 7/182* (2016.01)
*B65H 29/00* (2006.01)
*G07D 11/00* (2019.01)

(52) U.S. Cl.
CPC ..... *B65H 29/006* (2013.01); *G07D 11/00* (2013.01); *G07D 11/0003* (2013.01);
(Continued)

(58) Field of Classification Search
CPC .. G07D 7/00; G07D 7/06; G07D 7/12; G07D 7/15; G07D 2207/00; G07D 2211/00;
(Continued)

(56) References Cited

U.S. PATENT DOCUMENTS 5,506,660 A 4/1996 Rabb et al.
6,640,156 B1 * 10/2003 Brooks ..... G07D 11/0081 209/534

(Continued)

FOREIGN PATENT DOCUMENTS

CN 1228132 A 9/1999
CN 1395715 A 2/2003

(Continued)

OTHER PUBLICATIONS

Written Opinion of the International Searching Authority for International Application No. PCT/CN2015/086730 dated Nov. 30, 2015.

(Continued)

*Primary Examiner* — Jeffrey A Shapiro
(74) *Attorney, Agent, or Firm* — Wolf, Greenfield & Sacks, P.C.

(57) ABSTRACT

A banknote rolling-out control method and apparatus and a banknote storage device are provided for solving the technical problem of device failure caused by the case where a banknote can easily be stuck in the device after being stored on a reel for a long time. The method includes: storing a rolling-in time at which a banknote enters a device and a corresponding banknote sequence number; obtaining a rolling-out time of a current banknote which needs to be rolled out; obtaining the rolling-in time corresponding to the banknote sequence number of the current banknote; and determining whether the rolling-in time and the rolling-out time satisfies a preset time condition, and rolling out the
(Continued)

current banknote at a rolling-out speed lower than a preset speed in a case of a positive determination.

5 Claims, 6 Drawing Sheets

(52) U.S. Cl.
CPC ..... *G07D 11/0006* (2013.01); *G07D 11/0012* (2013.01); *G07D 11/0021* (2013.01); *G07D 11/0024* (2013.01); *G07D 11/0051* (2013.01); *G07D 11/0054* (2013.01); *G07D 11/0057* (2013.01); *G07D 11/0063* (2013.01); *G07D 11/0066* (2013.01); *G07D 11/0069* (2013.01); *G07D 11/0072* (2013.01); *B65H 2301/4191* (2013.01); *B65H 2513/10* (2013.01); *B65H 2553/41* (2013.01); *B65H 2701/1912* (2013.01)

(58) Field of Classification Search
CPC ..... G07D 11/0054; G07D 11/0057; G07D 11/006; G07D 11/0063; G07D 11/0066; G07D 11/0069; G07D 11/0072; G07D 11/0075; G07D 11/0084; G07D 19/00; G07D 11/00; G07D 11/0003; G07D 11/0006; G07D 11/0009; G07D 11/0012; G07D 11/0021; G07D 11/0024; G07D 11/0045; G07D 11/0048; G07D 11/0051; G07D 7/181; G07D 7/182; G07F 7/04; G07F 19/20; G07F 19/201; G07F 19/205; G07F 19/207; G07F 19/209; B65H 2701/1912; B65H 29/00; B65H 2553/00; B65H 29/66; B65H 29/6645; B65H 29/669; B65H 31/00; B65H 2301/4191; B65H 29/006; B65H 2553/41; B65H 2513/10; B07C 5/34; G06Q 20/1085; G06Q 20/108
USPC ..... 194/206, 207; 209/534; 235/379; 242/528; 271/176, 216
See application file for complete search history.

(56) References Cited

U.S. PATENT DOCUMENTS

| | | | | |
|---|---|---|---|---|
| 2002/0113160 | A1* | 8/2002 | Niioka | B65H 29/006 242/528 |
| 2003/0000957 | A1 | 1/2003 | Brexel et al. | |
| 2006/0017959 | A1 | 1/2006 | Downer et al. | |
| 2006/0285858 | A1 | 12/2006 | Shin | |
| 2007/0063426 | A1 | 3/2007 | Yui | |
| 2008/0038038 | A1* | 2/2008 | Arai | G07D 11/0039 400/582 |
| 2010/0100245 | A1 | 4/2010 | Oishi et al. | |
| 2012/0261874 | A1* | 10/2012 | Arikata | G07D 11/0081 271/9.01 |
| 2013/0081922 | A1* | 4/2013 | Amo | B65H 29/006 194/206 |
| 2014/0090949 | A1* | 4/2014 | Suetaka | B65H 5/28 194/206 |
| 2014/0188433 | A1 | 7/2014 | Erath et al. | |
| 2014/0262678 | A1* | 9/2014 | Ohara | G07D 11/0084 194/206 |
| 2016/0167913 | A1 | 6/2016 | Xiao et al. | |

FOREIGN PATENT DOCUMENTS

| | | | |
|---|---|---|---|
| CN | 1881097 | A | 12/2006 |
| CN | 1931691 | A | 3/2007 |
| CN | 2884343 | Y | 3/2007 |
| CN | 101071517 | A | 11/2007 |
| CN | 101955081 | A | 1/2011 |
| CN | 102837985 | A | 12/2012 |
| CN | 102930638 | A | 2/2013 |
| CN | 103345797 | A | 10/2013 |
| CN | 103608815 | A | 2/2014 |
| CN | 103608851 | A | 2/2014 |
| CN | 103676990 | A | 3/2014 |
| CN | 103754688 | A | 4/2014 |
| CN | 104282075 | A | 1/2015 |
| CN | 104637156 | A | 5/2015 |
| EP | 2 150 942 | | 2/2010 |
| JP | 3534966 | B2 | 6/2004 |
| JP | 5277443 | B2 | 8/2013 |
| WO | WO 98/06897 | A1 | 2/1998 |

OTHER PUBLICATIONS

International Search Report for Application No. PCT/CN2015/086730 dated Nov. 30, 2015.
Extended European Search Report for Application No. EP 15884352.4 dated Mar. 22, 2018.

* cited by examiner

BANKNOTE ROLLING-OUT CONTROL METHOD AND APPARATUS, AND BANKNOTE STORAGE DEVICE

The present application is the national phase of International Patent Application No. PCT/CN2015/086730, titled "BANKNOTE ROLLING-OUT CONTROL METHOD AND APPARATUS, AND BANKNOTE STORAGE DEVICE", filed on Aug. 12, 2015, which claims priority to Chinese Patent Application No. 201510100824.0, titled "BANKNOTE ROLLING-OUT CONTROL METHOD AND APPARATUS, AND BANKNOTE STORAGE DEVICE", filed on Mar. 6, 2015 with the State Intellectual Property Office of the People's Republic of China, both of which are incorporated herein by reference in their entireties.

FIELD

The present disclosure relates to the field of a financial self-service device, and particularly to a banknote rolling-out control method, a banknote rolling-out control apparatus and a banknote storage device.

BACKGROUND

A presently used mechanism of a reel/tape is a common storage means for banknotes. The storage device includes a storage reel driven by a first power motor, a tape backup reel driven by a second power motor, an outer channel of the storage mechanism driven by a third power motor. Two ends of the tape are fixed on the storage reel and the tape backup reel respectively. The wound tape is received or released by the storage reel and the tape backup reel. The first power motor, the second power motor and the third power motor are all controlled to start or stop by a micro controller. This storage device stores banknotes with the working principle of cooperation between the reel and the tape.

A currently existing control method for rolling a banknote in or out of a device is as follows. The third power motor drives the outer channel of the device to convey the banknote into the device. Then the first power motor drives the storage reel to receive the tape to store the banknote on the storage reel. The second power motor drives the tape backup reel to receive the tape in order to roll the banknote out of the device at a preset speed. Then the third power motor drives the outer channel of the device to convey the banknote to any other device. A disadvantage of the control method is that if the banknote is stored in the storage reel for a long time, the banknote is shaped as an arc due to the radian of the storage reel. In this case, if the banknote is rolled out at the fast preset speed (because of a requirement on the speed at which the device rolls out the banknote, the rolling-out speed is always fast), the rolled out banknote easily gets stuck in the device, which causes a fault in the device.

SUMMARY

A banknote rolling-out control method, a banknote rolling-out control apparatus and a banknote storage device are provided according to embodiments of the present disclosure, which may solve the technical problem that a banknote stored in a reel for a long time easily gets stuck in the device when it is rolled out, which causes a fault in the device.

The banknote rolling-out control method provided according to an embodiment of the present disclosure includes:

storing a rolling-in time at which a banknote enters a device and a corresponding banknote sequence number;

obtaining a rolling-out time of a current banknote which needs to be rolled out;

obtaining the rolling-in time corresponding to the banknote sequence number of the current banknote;

determining whether the rolling-in time and the rolling-out time satisfies a preset time condition and rolling out the current banknote at a rolling-out speed lower than a preset speed in a case that the rolling-in time and the rolling-out time satisfies the preset time condition.

Optionally, the determining whether the rolling-in time and the rolling-out time satisfies a preset time condition and rolling out the current banknote at a rolling-out speed lower than a preset speed in a case that the rolling-in time and the rolling-out time satisfies the preset time condition includes:

calculating a storage time length based on the rolling-in time and the rolling-out time;

determining whether the storage time length is greater than the preset time value and rolling out the current banknote at a preset low rolling-out speed in a case that the storage time length is greater than the preset time value, where the low rolling-out speed is less than the preset speed.

Optionally, after rolling out the current banknote at a rolling-out speed lower than a preset speed, the method further includes:

recovering the current rolling-out speed to the preset speed.

A banknote rolling-out control apparatus provided according to an embodiment of the present disclosure includes:

a storage unit, configured to store a rolling-in time at which a banknote enters a device and a corresponding banknote sequence number;

a rolling-out time obtaining unit, configured to obtain a rolling-out time of a current banknote which needs to be rolled out;

a rolling-in time obtaining unit, configured to obtain the rolling-in time corresponding to the banknote sequence number of the current banknote;

a determining unit, configured to determine whether the rolling-in time and the rolling-out time satisfies a preset time condition;

a rolling out unit, configured to roll out the current banknote at a rolling-out speed lower than a preset speed in a case that the determining unit determines that the rolling-in time and the rolling-out time satisfies the preset time condition.

Optionally, the determining unit specifically includes:

a calculating sub-unit, configured to calculate a storage time length based on the rolling-in time and the rolling-out time;

a determining sub-unit, configured to determine whether the storage time length is greater than the preset time value.

Optionally, the apparatus further includes:

a recovering unit, configured to recover the current rolling-out speed to the preset speed.

A banknote storage device provided according to an embodiment of the present disclosure includes: a first photoelectric sensor, a second photoelectric sensor, a storage reel, a tape backup reel, a tape, a conveying channel, a first power motor, a second power motor, a third power motor, an information storage unit and a micro-processor.

The first photoelectric sensor is arranged on the conveying channel, and is configured to feedback first information to the micro-processor when a banknote is rolled into the banknote storage device via the conveying channel.

The second photoelectric sensor is arranged on the conveying channel, and is configured to feedback second information to the micro-processor when the banknote is rolled out from the banknote storage device via the conveying channel.

When the micro-processor obtains the first information, the information storage unit stores a rolling-in time and a corresponding banknote sequence number of the banknote. When the micro-processor obtains the second information, the micro-processor obtains a rolling-out time of the banknote and reads the rolling-in time of the banknote from the information storage unit according to the banknote sequence number of the banknote, calculates a storage time length of the banknote stored in the banknote storage device based on the rolling-out time and the rolling-in time. The micro-processor determines whether the storage time length satisfies a preset time condition and adjusts the second power motor to roll out the banknote at a rolling-out speed lower than a preset speed in a case that the storage time length satisfies the preset time condition.

From the above technical solutions, the embodiments of the present disclosure have the following advantages.

In the embodiments of the present disclosure, firstly, the rolling-in time at which the banknote enters the device and the corresponding banknote sequence number are stored. Then the rolling-out time of the current banknote which needs to be rolled out is obtained. Subsequently, the rolling-in time is obtained according to the banknote sequence number of the current banknote. Finally, whether the rolling-in time and the rolling-out time satisfies the preset time condition is determined. The current banknote is rolled out at the rolling speed lower than the preset speed in a case that the rolling-in time and the rolling-out time satisfies the preset time. In the embodiments of the present disclosure, whether the current banknote is shaped as an arc is determined based on the rolling-in time and the rolling-out time of the current banknote. The current banknote is rolled out at the rolling speed lower than the preset speed in a case that the current banknote is shaped as an arc to prevent the banknote from getting stuck in the device so as to avoid a fault in the device.

DETAILED DESCRIPTION OF EMBODIMENTS

A banknote rolling-out control method, a banknote rolling-out control apparatus and a banknote storage device are provided according to embodiments of the present disclosure, which may solve a technical problem that a banknote stored in a reel for a long time easily gets stuck in a device when it is rolled out, which cause a fault in the device.

In order to make the invention objective, characteristics and advantages of the present disclosure more clear and easy to understand, hereinafter the technical solutions of the embodiments of the present disclosure are described clearly and completely in conjunction with drawings of the embodiments of the present disclosure. Apparently, the described embodiments are only a part of rather than all of the embodiments of the present disclosure. Based on the embodiments of the present disclosure, all other embodiments obtained by those skilled in the art without any creative work belong to a protective scope of the present disclosure.

Figure 1:
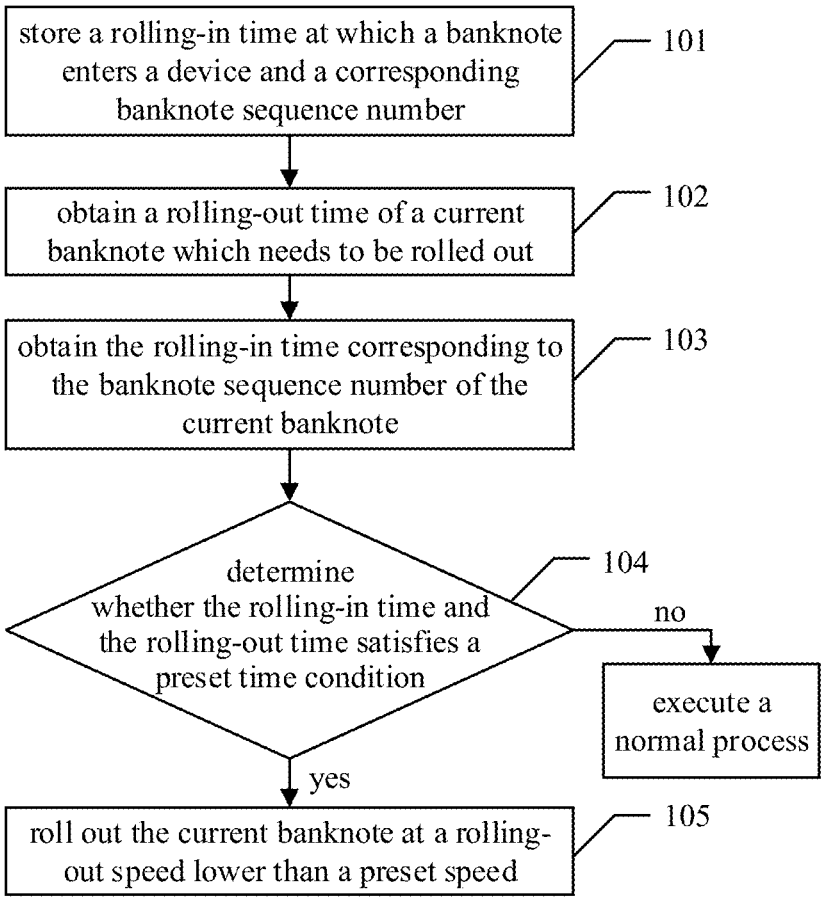
FIG. 1 is a flow chart of a banknote rolling-out control method according to an embodiment of the present disclosure.

Referring to FIG. 1, a banknote rolling-out control method according to an embodiment of the present disclosure includes the following steps 101 to 105.

In step 101, a rolling-in time at which a banknote enters a device and a corresponding banknote sequence number are stored.

Firstly, the rolling-in time at which the banknote enters the device and the corresponding banknote sequence number are stored.

In step 102, a rolling-out time of a current banknote needing to be rolled out is obtained.

When the banknote is prepared to be rolled out, the rolling-out time of the current banknote needing to be rolled out may be obtained.

In step 103, the corresponding rolling-in time is obtained according to the banknote sequence number of the current banknote.

When the banknote is prepared to be rolled out, the corresponding rolling-in time may be obtained according to the banknote sequence number of the current banknote.

In step 104, whether the rolling-in time and the rolling-out time satisfies a preset time condition is determined. In a case that the rolling-in time and the rolling-out time satisfies the preset time condition, step 105 is executed. In a case that the rolling-in time and the rolling-out time does not satisfy the preset time condition, a normal process is executed.

After the rolling-in time and the rolling-out time of the current banknote is obtained, whether the rolling-in time and the rolling-out time satisfies the preset time condition may be determined. In a case that the rolling-in time and the rolling-out time satisfies the preset time condition, step 105 is executed. In a case that the rolling-in time and the rolling-out time does not satisfy the preset time condition, the normal process is executed.

In step 105, the current banknote is rolled out at a rolling-out speed lower than a preset speed.

In a case that the rolling-in time and the rolling-out time satisfies the preset time condition, the current banknote may be rolled out at the rolling-out speed lower than the preset speed. It should be understood that, the above preset speed is a speed at which the banknote is rolled out in the normal process, which generally is a default rolling-out speed.

In the embodiments of the present disclosure, firstly, the rolling-in time at which the banknote enters the device and the corresponding banknote sequence number are stored. Then the rolling-out time of the current banknote needing to be rolled out is obtained. Subsequently, the rolling-in time is obtained according to the banknote sequence number of the current banknote. Finally, whether the rolling-in time and the rolling-out time satisfies the preset time condition is determined. The current banknote is rolled out at the rolling speed lower than the preset speed in a case that the rolling-in time and the rolling-out time satisfies the preset time. In the embodiments of the present disclosure, whether the current banknote is shaped as an arc is determined based on the rolling-in time and the rolling-out time of the current banknote. The current banknote is rolled out at the rolling speed lower than the preset speed in a case that the current banknote is shaped as an arc to prevent the banknote from getting stuck in the device so as to avoid a fault in the device.

Figure 2:
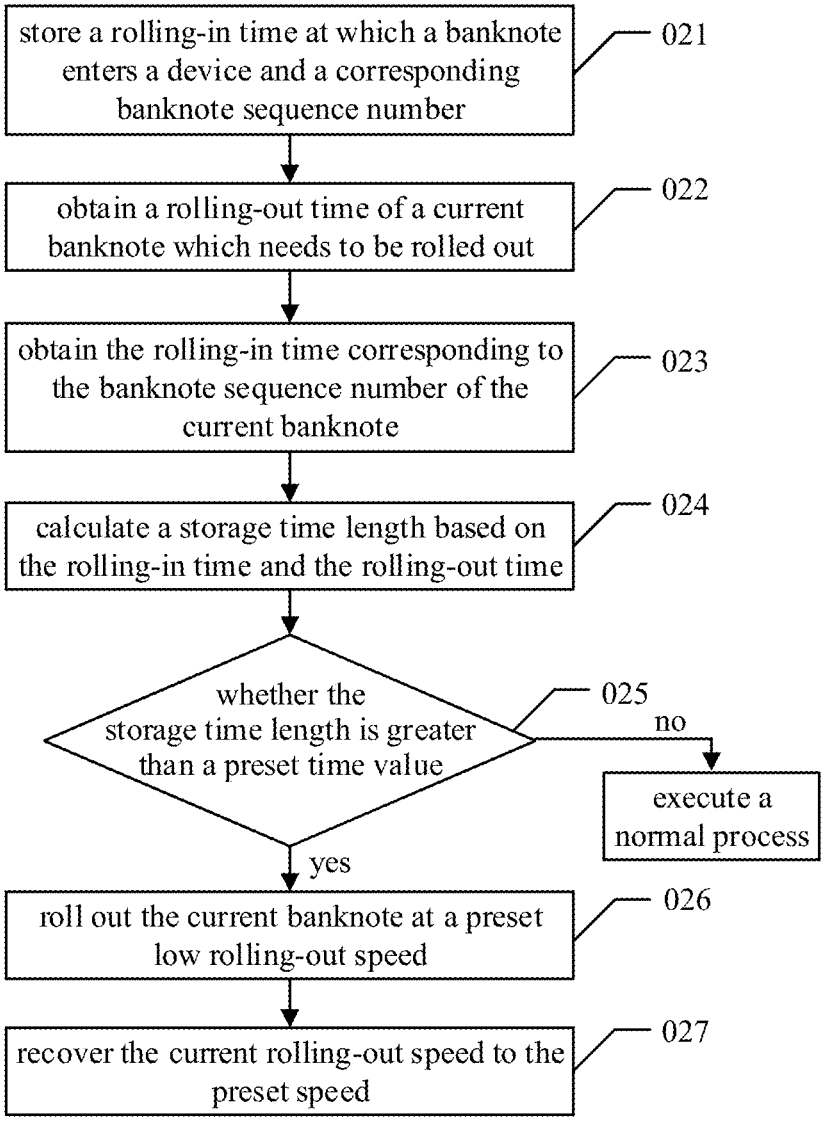
FIG. 2 is another flow chart of a banknote rolling-out control method according to another embodiment of the present disclosure.

In order to make the present disclosure easy to understand, hereinafter a banknote rolling-out control method in the embodiment of the present disclosure is described in detail. Referring to FIG. 2, a banknote rolling-out control method according to another embodiment of the present disclosure includes the following steps 021 to 027.

In step 021, a rolling-in time at which a banknote enters a device and a corresponding banknote sequence number are stored.

When the banknote enters the device, the rolling-in time at which the banknote enters the device and the corresponding banknote sequence number are stored. It should be understood, the banknote sequence number is a sequence number that the banknote enters the device. For example, a banknote that enters the device the first may be numbered 001, the next one is numbered 002, and so on. The number sequence may be stored in a queue in a first in first out manner.

In step 022, a rolling-out time of a current banknote needing to be rolled out is obtained.

When a current banknote needs to be rolled out, the rolling-out time of the current banknote may be obtained.

In step 023, the corresponding rolling-in time is obtained according to the banknote sequence number of the current banknote.

When the rolling-out time of the current banknote is obtained, the corresponding rolling-in time may be obtained according to the banknote sequence number of the current banknote. It is known that, since a rolling-in time and a corresponding banknote sequence number of each banknote are stored when it enters the device, when the banknote is rolled out, a system may reads the corresponding rolling-in time according to the banknote sequence number.

In step 024, a storage time length is calculated based on the rolling-in time and the rolling-out time.

After the rolling-in time and the rolling-out time of the current banknote are obtained, the storage time length may be calculated based on the rolling-in time and the rolling-out time. It is easy to understand that the storage time length may be calculated as a difference obtained by subtracting the rolling-in time from the rolling-out time.

In step 025, whether the storage time length is greater than a preset time value is determined. In a case that the storage time length is greater than the preset time value, step 026 is executed. In a case that the storage time length is not greater than the preset time value, a normal process is executed.

After the storage time length of the current banknote is obtained, whether the storage time length is greater than the preset time value may be determined. In a case that the storage time length is greater than the preset time value, step 026 is executed. In a case that the storage time length is not greater than the preset time value, a normal process is executed. It should be understood that, if the banknote is stored in a storage reel for a long time, the banknote is shaped as an arc. The preset time value may be set according to characteristics of different devices or banknotes, which is a boundary value for shaping a banknote as an arc. That is, if the storage time length is less than or equal to the preset time value, it may be considered that the current banknote is not shaped as an arc, and if the storage time length is greater than the preset time value, it may be considered that the current banknote is shaped as an arc, and step 026 needs to be performed.

It should be noted that the above executing the normal process generally is rolling out the current banknote at a preset speed.

In step 026, the current banknote is rolled out at a preset low rolling-out speed.

If the storage time length is greater than the preset time value, the current banknote may be rolled out at the preset low rolling-out speed. The low rolling-out speed is less than the preset speed.

It should be noted that the preset low rolling-out speed may be set according to real situations. Besides, the setting may be graded according to how much the storage time length is greater than the preset time value. For example, if the storage time length is 30% greater than the preset time value, the current banknote is rolled out at a first low rolling-out speed, which is 50% of the preset speed. If the storage time length is 50% greater than the preset time value, the current banknote is rolled out at a first low rolling-out speed, which is 30% of the preset speed. If the storage time length is 80% greater than the preset time value, the current banknote is rolled out at a first low rolling-out speed, which is 20% of the preset speed. Such setting may make an estimated degree of the arc shape generated due to long time of storage to correspond to a different rolling-out speed, and thus compromise between the rolling-out efficiency and avoiding stuck banknote.

In step 027, the current rolling-out speed is recovered to the preset speed.

After the current banknote is rolled out at the preset low rolling-out speed, the current rolling-out speed may be recovered to the preset speed. It should be understood that, after the current rolling-out speed is lowered to the low rolling-out speed to roll out the current banknote, the current rolling-out speed may be recovered to the preset speed so as to ensure an entire rolling-out efficiency of the device.

In order to make the method easy to be understood, according to the embodiment illustrated in FIG. 2, the banknote rolling-out control method according to the embodiment of the disclosure is described with a real application scenario.

1. A banknote enters a device at a constant speed V0 via an outer channel of the device.

2. After a back-end of the banknote leaves a first photoelectric sensor, an information storage unit stores an entering time T of the banknote and stores a sequence number N that the banknote enters the device.

3. A second power motor drives a tape backup reel to receive a tape at a normal speed V to roll out the banknote. When a front-end of the banknote enters a second photoelectric sensor, a time $T_{in}$ at which the banknote enters the device is read from the information storage unit according to the banknote sequence number N.

4. A storage time length during which the banknote is stored in the device is calculated according to a rolling-out time $T_{out}$ as:

$$T_{storage}=T_{out}-T_{in}.$$

5. A time $T_{shape}$ for shaping the banknote as a serious arc is determined according to a material of the banknote in combination with a test result.

6. A detecting unit detects whether the $T_{storage}$ that the banknote is stored in the device is greater than the time $T_{shape}$ for shaping the banknote as a serious arc.

If $T_{storage}<T_{shape}$, it indicates that the banknote is not shaped as a serious arc. The banknote is rolled out at a normal speed $V_{normal}$.

If $T_{storage}\geq T_{shape}$, it indicates that the banknote is shaped as a serious arc. A situation that the banknote gets stuck can readily occur if rolling out the banknote at the normal speed. At this time, a banknote control unit adjusts a speed of the second power motor to adjust the banknote rolling-out speed from the normal speed $V_{normal}$ to a low speed $V_{low}$. The low speed ensures the banknote being steadily rolled out via the inner channel of the device.

Figure 3:
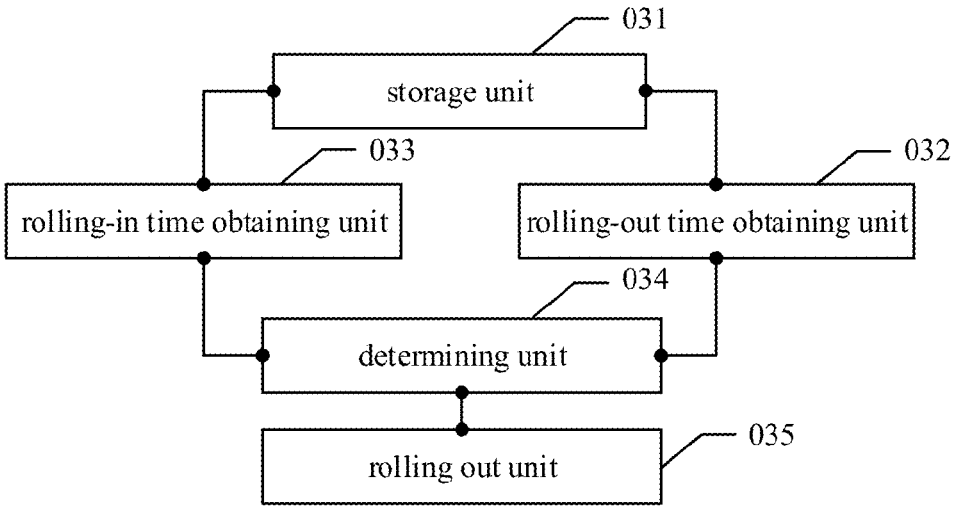
FIG. 3 is a structural diagram of a banknote rolling-out control apparatus according to an embodiment of the present disclosure.

Above the banknote rolling-out control method is described. Hereinafter a banknote rolling-out control apparatus is described in detail. Referring to FIG. 3, a banknote rolling-out control apparatus according to an embodiment of the present disclosure includes a storage unit 031, a rolling-out time obtaining unit 032, a rolling-in time obtaining unit 033, a determining unit 034, and a rolling out unit 035.

The storage unit 031 is configured to store a rolling-in time at which a banknote enters a device and a corresponding banknote sequence number.

The rolling-out time obtaining unit 032 is configured to obtain a rolling-out time of a current banknote which needs to be rolled out.

The rolling-in time obtaining unit 033 is configured to obtain the corresponding rolling-in time according to the banknote sequence number of the current banknote.

The determining unit 034 is configured to determine whether the rolling-in time and the rolling-out time satisfies a preset time condition.

The rolling out unit 035 is configured to roll out the current banknote at a rolling-out speed lower than a preset speed in a case that the determining unit determines that the rolling-in time and the rolling-out time satisfies the preset time condition.

In the embodiment, firstly, the storage unit 031 stores the rolling-in time at which the banknote enters the device and the corresponding banknote sequence number. Then the rolling-out time obtaining unit 032 obtains the rolling-out time of the current banknote which needs to be rolled out. Subsequently, the rolling-in time obtaining unit 033 obtains the corresponding rolling-in time according to the banknote sequence number of the current banknote. Finally, the determining unit 034 determines whether the rolling-in time and the rolling-out time satisfies the preset time condition. The rolling out unit 035 rolls out the current banknote at the rolling-out speed lower than the preset speed in a case that the determining unit determines that the rolling-in time and the rolling-out time satisfies the preset time condition. In the embodiment, whether the current banknote is shaped as an arc is determined based on the rolling-in time and the rolling-out time. If the current banknote is shaped as an arc, the current banknote is rolled out at a rolling-out speed lower than the preset speed to prevent the banknote from getting stuck in the device so as to avoid a fault in the device.

Figure 4:
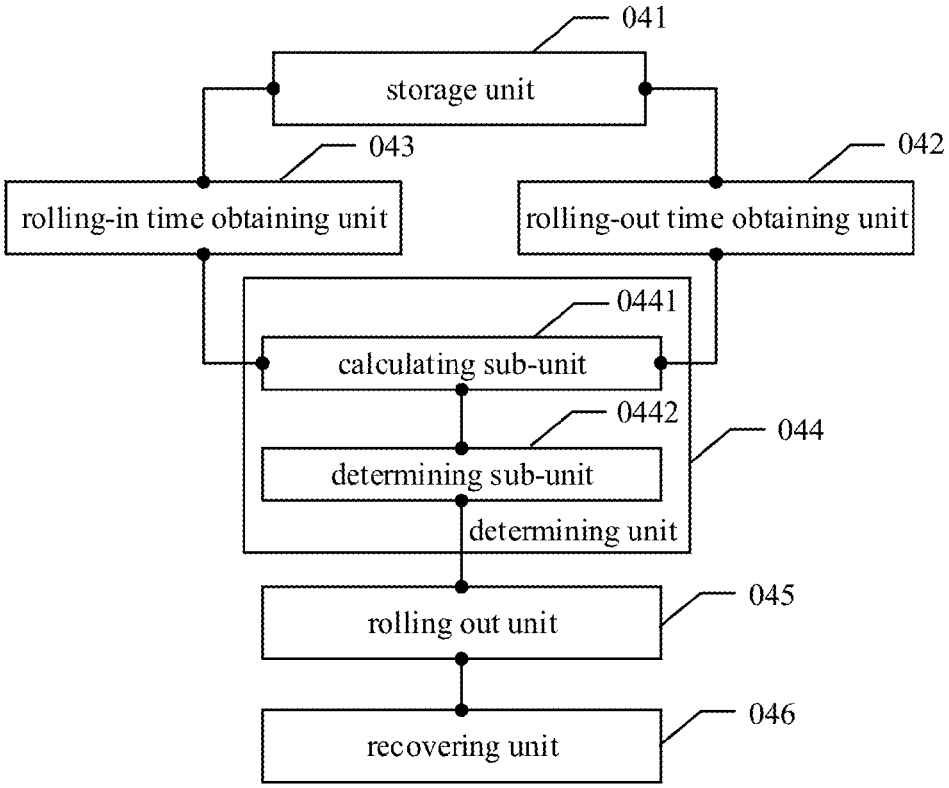
FIG. 4 is another structural diagram of a banknote rolling-out control apparatus according to another embodiment of the present disclosure.

In order to make the apparatus to be easily understood, hereinafter a banknote rolling-out apparatus in the embodiments of the present disclosure is described in detail. Referring to FIG. 4, a banknote rolling-out apparatus according to another embodiment of the present disclosure includes a storage unit 041, a rolling-out time obtaining unit 042, a rolling-in time obtaining unit 043, a determining unit 044, and a rolling out unit 045.

The storage unit 041 is configured to store a rolling-in time at which a banknote enters a device and a corresponding banknote sequence number.

The rolling-out time obtaining unit 042 is configured to obtain a rolling-out time of a current banknote which needs to be rolled out.

The rolling-in time obtaining unit 043 is configured to obtain the corresponding rolling-in time according to the banknote sequence number of the current banknote.

The determining unit 044 is configured to determine whether the rolling-in time and the rolling-out time satisfies a preset time condition.

The rolling out unit 045 is configured to roll out the current banknote at a rolling-out speed lower than a preset speed in a case that the determining unit determines that the rolling-in time and the rolling-out time satisfies the preset time condition.

The determining unit 44 in the embodiment may further include a calculating sub-unit 0441 and a determining sub-unit 0442.

The calculating sub-unit 0441 is configured to calculate a storage time length based on the rolling-in time and the rolling-out time.

The determining sub-unit 0442 is configured to determine whether the storage time length is greater than the preset time value.

The banknote rolling-out control apparatus in the embodiment may further include a recovering unit 046.

The recovering unit 046 is configured to recover the current rolling-out speed to the preset speed.

Figure 5:
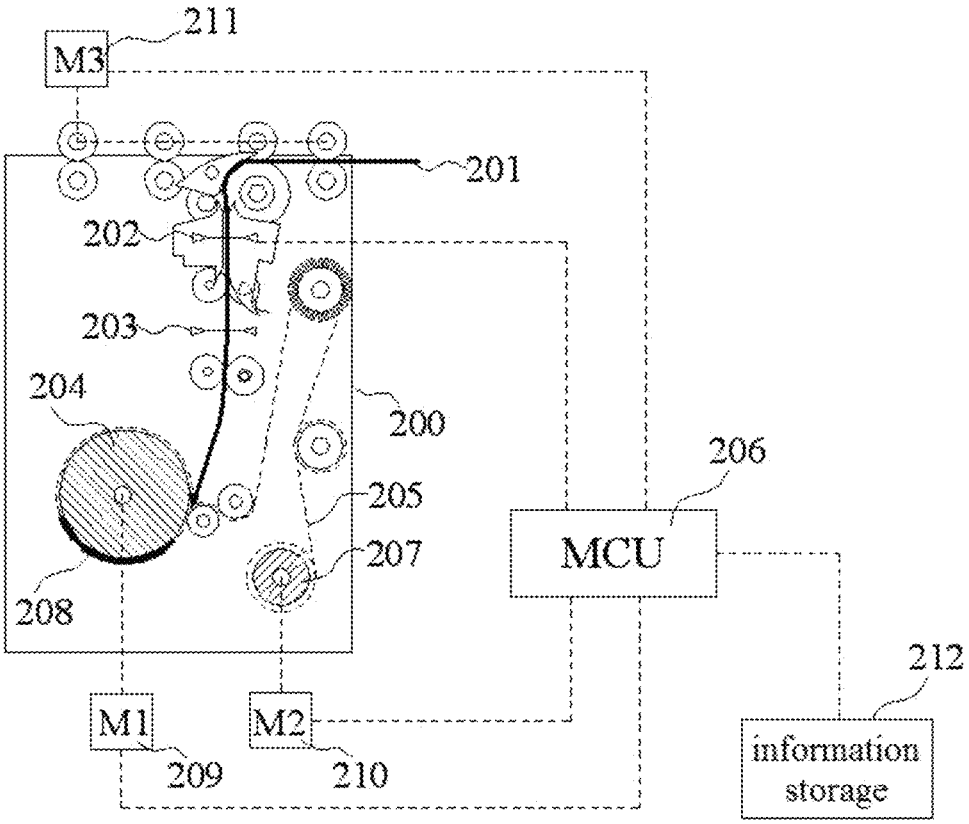
FIG. 5 is a schematic structural diagram of a banknote storage device according to an embodiment of the present disclosure.

Above the banknote rolling-out control apparatus is described. Hereinafter a banknote storage device is described in detail. Referring to FIG. 5, a banknote storage device according to an embodiment of the present disclosure is illustrated.

FIG. 5 is a side view of the storage device 200 according to the present disclosure. The device includes a first photoelectric sensor 202, a second photoelectric sensor 203, a storage reel 204, a tape backup reel 207, a tape 205, a conveying channel 201, a first power motor 209, a second power motor 210, a third power motor 211, an information storage unit 212, and a micro-processor 206.

The micro-processor 206 controls the first power motor 209 and the second power motor 210. The first power motor 209 drives the storage reel 204. The second power motor 210 drives the tape backup reel 207. The first photoelectric sensor 202 divides the conveying channel 201 into an outer channel and an inner channel of the device. The third power motor 211 drives the outer channel of the device. The tape 205 is fixed on the storage reel 204 and the tape backup reel 207. A banknote 208 enters the device 200 via the conveying channel 201 and is stored on the storage reel 204 via the tape 205. The first sensor 202 detects the banknote 208 entering the device 200. The second sensor 203 detects the banknote 208 being rolled out of the device 100. The information storage unit 212 stores the information of time of year, month and day at which a banknote enters the device and a sequence number.

Figure 7:
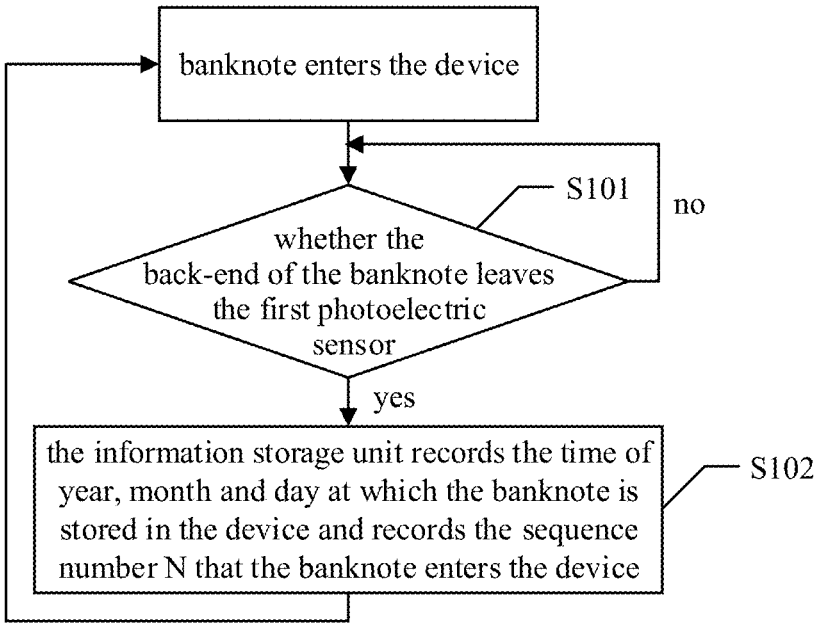
FIG. 7 is a control flow chart for a banknote entering a device according to an embodiment of the present disclosure.

A control principle for rolling the banknote into the device is illustrated with reference to FIG. 5 and FIG. 7.

In step S101, the third power motor 211 drives an outer part of the conveying channel 201 to convey the banknote 208 into the device 200. The first power motor 209 drives the storage reel 204 to receive the tape 205 in order to roll the banknote in the storage reel. In a process that the banknote enters the device 200, whether a back-end of the banknote leaves the first photoelectric sensor 202 is determined.

In step S102, when the back-end of the banknote leaves the first photoelectric sensor 202, information of a time T of year, month and day at which the banknote enters the device and a sequence number N are stored in the information storage unit 212.

The steps S01-S02 are repeatedly performed to store entering time and sequence information of all banknotes entering the device in the information storage unit 212.

Figure 6:
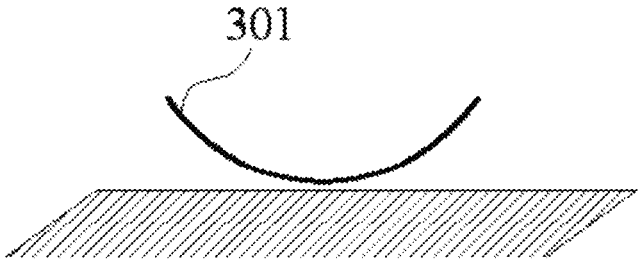
FIG. 6 is a diagram illustrating a banknote arc related to the present disclosure.
Figure 8:
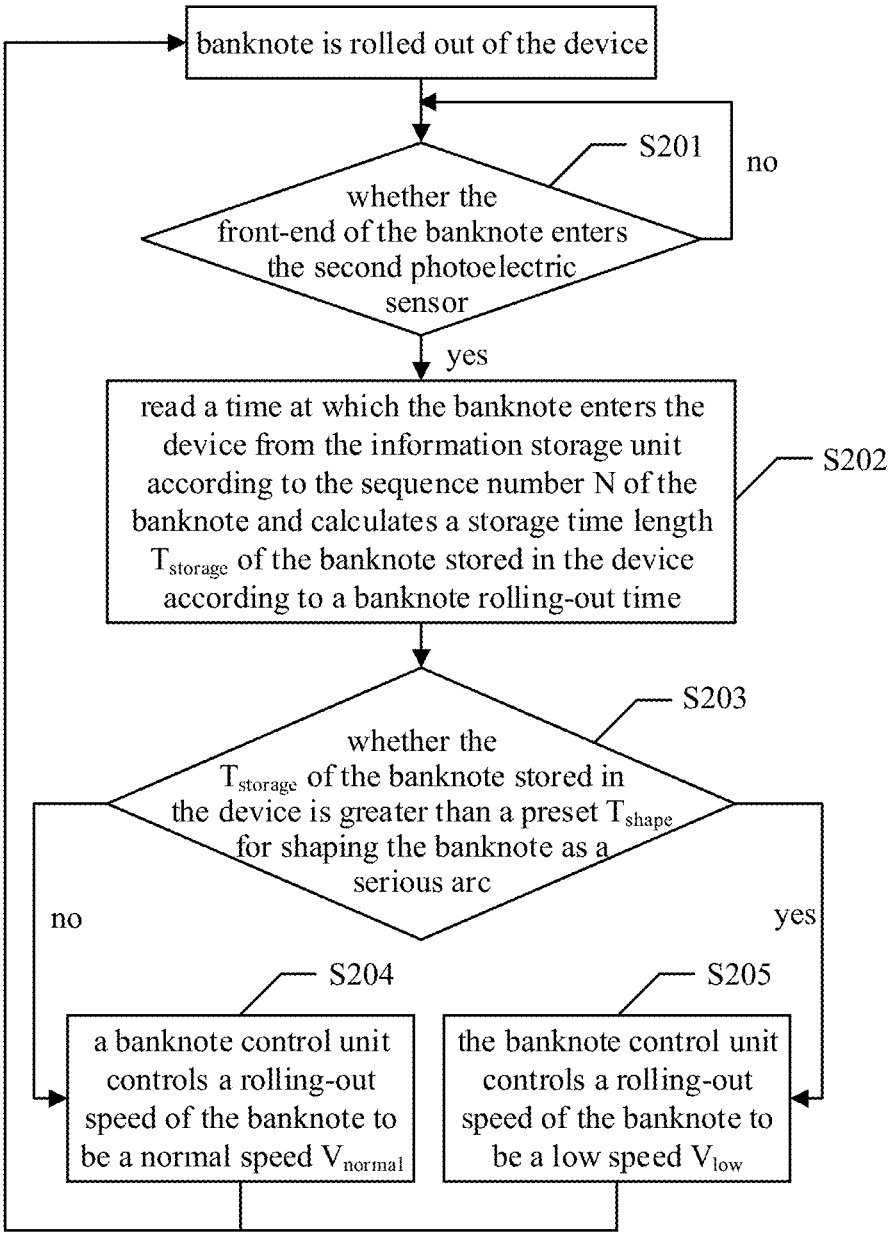
FIG. 8 is a control flow chart for a banknote being rolled out of a device according to an embodiment of the present disclosure.

A control principle for rolling the banknote out of the device is illustrated with reference to FIG. 5, FIG. 6 and FIG. 8.

In step S201, the second power motor 201 drives the tape backup reel 207 to receive the tape 205 in order to roll the banknote out of the device 200. In a process that the banknote is rolled out of the device, whether a front-end of the banknote enters the second photoelectric sensor 203 is determined.

In step S202, when the front-end of the banknote enters the second photoelectric sensor 203, the micro-processor 206 reads a time information $T_{in}$ (in the unit of day) at which the banknote enters the device from the information storage unit 212 according to the sequence number N of the banknote and calculates a storage time length during which the banknote is stored in the device based on a banknote rolling-out time $T_{out}$:

$$T_{storage}=T_{out}-T_{in} \text{ (in the unit of day).}$$

In step S203, when the front-end of the banknote enters the second photoelectric sensor 203, a relationship between the storage time length $T_{storage}$ of the banknote and the time $T_{shape}$ for shaping the banknote as the serious arc is determined. FIG. 6 shows a banknote 301 which is shaped as a serious arc after the banknote is stored in the device for a long time. The time $T_{shape}$ for shaping the banknote as a serious arc in the device is pre-set according to a material of the banknote.

In step S204, if $T_{storage}<T_{shape}$, which indicates that the banknote is not shaped as a serious arc, the banknote is rolled out at a normal speed $V_{normal}$.

In step S205, if $T_{storage}\geq T_{shape}$, which indicates that the banknote is shaped as a serious arc and the banknote will easily get stuck if rolling out the banknote at the normal speed, the banknote control unit adjusts a speed of the second power motor to adjust the banknote rolling-out speed from the normal speed $V_{normal}$ to a low speed $V_{low}$. The low speed ensures the banknote being steadily rolled out via the inner channel of the device.

The steps S201-S205 are repeatedly performed to successfully roll all banknotes out of the device.

Hereinafter, the control principle is illustrated with reference to a practical control.

In a practical control, a normal speed for rolling out a banknote is denoted as $V_{normal}$=700 mm/s, a low speed is denoted as $V_{low}$=350 mm/s, and a preset time period for shaping a banknote as a serious arc is denoted as $T_{shape}$=10 days.

It is assumed that a time at which the banknote enters the device is Oct. 15, 2014, and the banknote is the eighth banknote that enters the device. The information is stored in a storage unit.

When the banknote is rolled out of the device on Nov. 15, 2014, the information that the banknote entered the device on Oct. 15, 2014 is read according to the sequence number 8. A storage time length during which the banknote is stored in the device is calculated as $T_{storage}$=30 days.

A relationship between the $T_{storage}$ and the $T_{shape}$ is determined. Because $T_{storage}>T_{shape}$, the banknote is rolled out at a low speed $V_{low}$=350 mm/s in order to prevent a situation that the arced banknote gets stuck.

Those skilled in the art may clearly understand that, in order to describe conveniently and concisely, for detailed working process of the above described system, apparatus and units, one may refer to the corresponding process of the above method embodiment, which is not repeated herein.

In the embodiments provided by the present disclosure, it should be understood that the system, the apparatus and the method may be implement by other methods. For example, the above described apparatus embodiments are only for illustration. For example, a division of the unit is merely a logic function division. In a real implementation, there may be other division manners. For example, multiple units or components may be combined or integrated to another system, or some characteristics may be ignored or not executed. Furthermore, a mutual coupling or a direct coupling or a communicative connection shown or discussed may be an indirect coupling or communicative connection via some interfaces, apparatuses or units, and may be electrical, mechanical or in other manners.

The above units described as discrete components may be or may not be physically separated. The components shown as units may be or may not be physical units. That is they may be located at a place or may be distributed to multiple network units. Part or all units may be selected according to a real requirement to implement an objective of the solution of the embodiment.

Besides, each functional unit in each embodiment of the present disclosure may be integrated in a processing unit or each unit may exist physically and separately, or two or more units may be integrated in a processing unit. The above integrated units may be implemented in a hardware manner or a software functional unit manner.

If the integrated units are implemented in the software functional unit manner and are sold or used as an independent product, they may be stored on a computer readable storage medium. Based on this understanding, the essence of the technical solution of the present disclosure or the part of a contribution to the conventional technology or all or part of the technical solution may be implemented in a form of software product. The computer software product is stored in a storage medium including multiple instructions used to make a computer device (which may be a personal computer, a server or a network device and so on) execute all or part of the steps of the method of each embodiment of the present disclosure. The above storage medium includes a USB, a portable hard disk, a read-only memory (ROM), a random access memory (RAM), a disk or a CD and many other medium that can store a program code.

The above embodiments are only used to illustrate the technical solutions of the present disclosure rather than limiting. Although the present disclosure is specifically described referring to the above embodiments, those skilled in the art can understand that they may modify the technical solutions described in the above embodiments or equivalently substitute part of technical features. All amendments or substitutions do not make a corresponding technical solution depart from the spirit or scope of the embodiments of the present disclosure.

The invention claimed is:

1. A banknote rolling control method, wherein, driving, by a third power motor, an outer channel of a conveying channel to convey a banknote into a storage device;

driving, by a first power motor, a storage reel to receive a tape, so that the banknote is rolled and stored by the storage reel; and storing, by an information storage unit upon determining that a back-end of the banknote leaves a first photoelectric sensor, a banknote sequence number of the banknote and a rolling-in time at which the banknote enters the storage device; wherein the first photoelectric sensor is arranged at a location at which the conveying channel is divided into the outer channel and an inner channel;

driving, by a second power motor, a tape backup reel to receive the tape, so that the banknote is rolled out from the storage reel;

obtaining, by a micro-processor, a rolling-out time of the banknote upon determining that a front-end of the banknote enters a second photoelectric sensor; wherein the second photoelectric sensor is close to the inner channel and is arranged at a location between the first photoelectric sensor and the storage reel;

obtaining, by the micro-processor, the rolling-in time of the banknote from the information storage unit based on the banknote sequence number of the banknote; and calculating, by the micro-processor, a storage time length of the banknote stored by the storage reel based on the rolling-in time and the rolling-out time;

determining, by the micro-processor, that the storage time length is greater than a preset time value; wherein the preset time value is for shaping the banknote as an arc by the storage reel, and wherein the preset time value is greater than n days, wherein n is a positive integer; and rolling out, by the second power motor, the banknote out of the inner channel at a preset low rolling-out speed by adjusting a rotation speed of the second power motor in a case that it is determined that the storage time length is greater than the preset time value, wherein the low rolling-out speed is less than a preset speed.

2. The method according to claim 1, wherein after rolling out, by the second power motor, the banknote at the preset low rolling-out speed which is lower than the preset speed, the method further comprising:

recovering the current preset low rolling-out speed to the preset speed.

3. A banknote rolling control apparatus, comprising:

a micro-processor;

a memory for storing instructions, when being executed by the micro-processor, cause the micro-processor to perform the following operations for rolling a banknote into a storage device and operations for rolling the banknote out of the storage device:

driving, by a third power motor, an outer channel of a conveying channel to convey the banknote into the storage device;

driving, by a first power motor, a storage reel to receive a tape, so that the banknote is rolled and stored by the storage reel;

storing, upon determining that a back-end of the banknote leaves a first photoelectric sensor, a banknote sequence number of the banknote and a rolling-in time at which the banknote enters the storage device; wherein the first photoelectric sensor is arranged at a location at which the conveying channel is divided into the outer channel and an inner channel;

driving, by a second power motor, a tape backup reel to receive the tape, so that the banknote is rolled out from the storage reel;

obtaining, a rolling-out time of the banknote upon determining that a front-end of the banknote enters a second photoelectric sensor; wherein the second photoelectric sensor is close to the inner channel and is arranged at a location between the first photoelectric sensor and the storage reel;

obtaining, the rolling-in time of the banknote from the information storage unit based on the banknote sequence number of the banknote; and calculating, a storage time length of the banknote stored by the storage reel based on the rolling-in time and the rolling-out time;

determining that the storage time length is greater than a preset time value; wherein the preset time value is for shaping the banknote as an arc by the storage reel; and wherein the preset time value is greater than n days, wherein n is a positive integer; and rolling out, by the second power motor, the banknote out of the inner channel at a preset low rolling-out speed by adjusting a rotation speed of the second power motor in a case that it is determined that the storage time length is greater than the preset time value, wherein the low rolling-out speed is less than a preset speed.

4. The apparatus according to claim 3, wherein when the instructions is executed by the micro processor, cause the micro-processor, to further perform operations for rolling a banknote out of the storage device:

recovering the current preset low rolling-out speed to the preset speed after the current banknote is rolled out at the preset low rolling-out speed which is lower than the preset speed.

5. A banknote storage device, comprising:

a first photoelectric sensor, a second photoelectric sensor, a storage reel, a tape backup reel, a tape, a conveying channel, a first power motor, a second power motor, a third power motor, an information storage unit and a micro-processor, wherein the first photoelectric sensor is arranged at a location at which the conveying channel is divided into an outer channel and an inner channel; wherein the second photoelectric sensor is close to the inner channel and is arranged at a location between the first photoelectric sensor and the storage reel; wherein, the third power motor is configured to drive the outer channel of the conveying channel to convey the banknote into the banknote storage device;

the first photoelectric sensor is configured to feedback first information to the micro-processor upon determining that a back-end of the banknote leaves the first photoelectric sensor;

the information storage unit is configured to store a rolling-in time at which the banknote enters the banknote storage device and a banknote sequence number of the banknote, when the micro-processor obtains the first information;

the first power motor is configured to drive the storage reel to receive the tape, so that the banknote is rolled and stored by the storage reel;

the second power motor is configured to drive the tape backup reel to receive the tape, so that the banknote is rolled out from the storage reel;

the second photoelectric sensor is configured to feedback second information to the micro-processor upon determining that a front-end of the banknote enters the second photoelectric sensor;

the micro-processor is configured to, when obtaining the second information, obtain a rolling-out time of the banknote and read the rolling-in time of the banknote from the information storage unit according to the banknote sequence number of the banknote, and calculate a storage time length of the banknote stored in the banknote storage device based on the rolling-out time and the rolling-in time;

the micro-processor is further configured to determine that the storage time length is greater than a preset time value; wherein the preset time value is for shaping the banknote as an arc by the storage reel; and wherein the preset time value is greater than n days, wherein n is a positive integer; and to adjust a rotation speed of the second power motor for rolling the banknote out of the inner channel from a preset speed to a preset low rolling-out speed, in a case that it is determined that the storage time length is greater than the preset time value, wherein the low rolling-out speed is less than the preset speed.

* * * * *